US011331528B2

(12) United States Patent
Amoroso et al.

(10) Patent No.: US 11,331,528 B2
(45) Date of Patent: May 17, 2022

(54) CALISTHENIC RINGS

(71) Applicants: Kevin A Amoroso, Walnut Creek, CA (US); Charles Leslie Floyd, Jr., Oakland, CA (US); Christopher A. Cuevas, Walnut Creek, CA (US)

(72) Inventors: Kevin A Amoroso, Walnut Creek, CA (US); Charles Leslie Floyd, Jr., Oakland, CA (US); Christopher A. Cuevas, Walnut Creek, CA (US)

( * ) Notice: Subject to any disclaimer, the term of this patent is extended or adjusted under 35 U.S.C. 154(b) by 0 days.

(21) Appl. No.: 16/758,279

(22) PCT Filed: Oct. 24, 2018

(86) PCT No.: PCT/US2018/057406
§ 371 (c)(1),
(2) Date: Apr. 22, 2020

(87) PCT Pub. No.: WO2019/084205
PCT Pub. Date: May 2, 2019

(65) Prior Publication Data

US 2020/0338381 A1 Oct. 29, 2020

Related U.S. Application Data

(60) Provisional application No. 62/576,568, filed on Oct. 24, 2017.

(51) Int. Cl.
*A63B 7/02* (2006.01)
*A63B 21/00* (2006.01)

(52) U.S. Cl.
CPC ..... *A63B 7/02* (2013.01); *A63B 21/4035* (2015.10); *A63B 21/4039* (2015.10)

(58) Field of Classification Search
CPC ..... A63B 7/02
See application file for complete search history.

(56) References Cited

U.S. PATENT DOCUMENTS

| | | | | |
|---|---|---|---|---|
| 2,198,075 | A * | 4/1940 | Borek | A63B 67/08 273/109 |
| 4,138,838 | A * | 2/1979 | Long | A01D 67/00 403/146 |
| 4,657,243 | A * | 4/1987 | Thomas | A63B 23/16 273/441 |
| D675,686 | S * | 2/2013 | Maki | A63B 21/4043 D21/662 |
| 9,463,369 | B2 * | 10/2016 | Ebsen | A63B 7/00 |
| D812,234 | S * | 3/2018 | Miller | D24/188 |
| 10,016,649 | B2 * | 7/2018 | Widerman | A63B 21/285 |
| 10,307,653 | B2 * | 6/2019 | Ebsen | A63B 5/16 |

(Continued)

FOREIGN PATENT DOCUMENTS

CS 198402 B1 4/1984

*Primary Examiner* — Joshua Lee
(74) *Attorney, Agent, or Firm* — West & Associates, A PC; Stuart J. West; Charlotte Rodeen-Dickert

(57) ABSTRACT

An advanced calisthenic ring comprising a substantially annular shape and various contiguous and smoothly interfaced regions within multiple planes to avoid abrading a user's arms when a user is performing a muscle up exercise. In some embodiments the device can also comprise a support element integral with the advanced calisthenic ring to aid a user in adopting a false grip position and/or facilitate performance of a muscle up exercise.

15 Claims, 4 Drawing Sheets

(56) References Cited

U.S. PATENT DOCUMENTS

| | | | | |
|---|---|---|---|---|
| 2010/0075819 | A1* | 3/2010 | Maki | A63B 21/4035 482/139 |
| 2014/0121064 | A1* | 5/2014 | Newman | A63B 21/4035 482/49 |
| 2015/0126334 | A1 | 5/2015 | Newman | |
| 2015/0133277 | A1* | 5/2015 | Alexandrov | A63B 21/16 482/131 |
| 2017/0296856 | A1 | 10/2017 | Burke | |

* cited by examiner

CALISTHENIC RINGS

CROSS-REFERENCE TO RELATED APPLICATION(S)

This application claims the benefit of priority under 35 U.S.C § 119(e) to prior filed provisional patent application Ser. No. 62/576,568, filed Oct. 24, 2017, the complete contents of which is hereby incorporated herein by reference.

BACKGROUND

Technical Field

The present device relates to the field of health and fitness and more specifically to the field of calisthenic rings.

Background

Conventional gymnastic rings, first known as the "Flying Rings" or "Still Rings", were invented in the early 1800s and were part of the 1896 and 1904 Olympics. They have not changed much since that time. They are generally made from laminated wood, iron, plastics and/or other appropriate materials and are around the same overall dimensions.

There are no specific ergonomic design features inherent or designed in these early rings, as much of the information we currently have on proper body mechanics and the benefits of ergonomically designed tools/products was either unknown, unavailable and/or simply not used in the original design.

To date, there are a few products on the market which attempt to address some of the inherent problems and/or limitations users run into while learning and practicing various techniques and/or exercises on the traditional rings. One such product is the OSO False Grip. The OSO False Grip is sold as a "snap on" muscle-up gymnastic ring grip attachment with a texture grip. However, there are inherent problems and limitations to a "snap on" gymnastic ring grip attachment, including, but limited to, bending, breaking, negative position shifting, negative increased circumference of grip, decreased interior circumference of the ring, texture deterioration and abrasion points. There is also the issue of points of discontinuity at the point where the ring meets the "snap on" attachment edges. At those points there is a loss and stoppage of flow or continuity as well as the possibility to cut or tear the skin due to the discontinuity.

What is needed is a modified gymnastic ring that is ergonomically configured to and fabricated to discontinuities and/or abrasion points/areas.

SUMMARY

One general aspect includes an apparatus can include a non-planar substantially annular member having a main region and a second region and a support element extending from a portion of said non-planar substantially annular member, where a first surface of said support element is instantaneously substantially orthogonal to said portion of said non-planar substantially annular member and where said first region of said non-planar substantially annular member is askew relative to said second region of said non-planar substantially annular member.

Additional embodiments can include one or more of the following features: The apparatus where the non-planar substantially annular member has a substantially smooth transition between said first region and said second region. The apparatus where said support element has a perimeter edge that is substantially approximating the perimeter edge of one quadrant of a lemniscate. The apparatus where said support element has a perimeter edge that is substantially approximating the perimeter edge of a longitudinally bisected teardrop shape. The apparatus where said portion of said non-planar substantially annular member is positioned at the substantially smooth transition between said first region and said second region. The apparatus where said non-planar substantially annular member is substantially rigid.

BRIEF DESCRIPTION OF THE DRAWINGS

Further details of the present device are explained with the help of the attached drawings in which:

FIGS. 5*a* and 5*b* depict an interior elevation view of a pair of advanced calisthenic rings.

DETAILED DESCRIPTION

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Figure 1A:
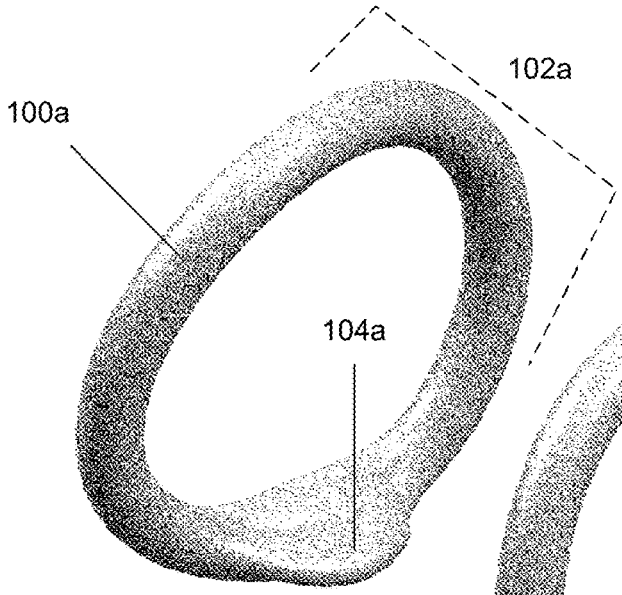
FIGS. 1*a* and 1*b* depict isometric views of a pair of advanced calisthenic rings.
Figure 1B:
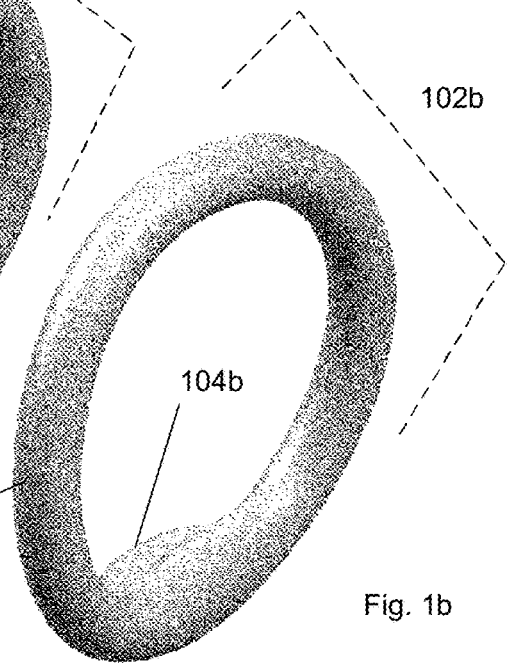

FIGS. 1*a* and 1*b* depict isometric views of advanced calisthenic rings 100*a* 100*b*. In the embodiment depicted in FIGS. 1*a* and 1*b*, the advanced calisthenic rings 100*a* and 100*b* are substantially annular members having first regions 102*a* 102*b* and support elements 104*a* and 104*b*. In some embodiments, the first regions 102*a* 102*b* can substantially reside in a plane that is askew from a second region of the calisthenic rings 100*a* 100*b* which can substantially reside in a second plane. As depicted in FIGS. 1*a* and 1*b*, transitions between said first regions 102*a* 102*b* and second regions can be smooth and continuous, absent discontinuities.

As depicted in FIGS. 1*a* and 1*b*, support elements 104*a* 104*b* can extend from surfaces of the advanced calisthenic rings 100*a* 100*b*. In some embodiments, the support elements 104*a* 104 be can be substantially orthogonally to each advanced calisthenic ring 100*a* 100*b*. Additionally, in some embodiments the first regions 102*a* 102*b* can extend out of plane from the main body of each of the advanced calisthenic rings 100*a* 100*b* on the opposite side of the support elements 104*a* 104*b* on each of the advanced calisthenic rings 100*a* 100*b*. As depicted in FIGS. 1*a* and 1*b*, the support elements 104*a* 104*b* can be integral with the advanced calisthenic rings 100*a* 100*b* and transitions between the main bodies of each of the advanced calisthenic rings 100*a*

100*b* and the support elements 104*a* 104*b* can be smooth and continuous, absent discontinuities.

In some embodiments, the advanced calisthenic rings 100*a* 100*b* can be comprised of heterogeneous and/or homogeneous material(s) such as wood, laminated wood, composite laminated wood, composite(s), metal(s), plastic(s) and/or any other known, convenient and/or desired material(s). In some embodiments, each of the advanced calisthenic rings 100*a* 100*b*, first regions 102*a* 102*b* and/or support elements 104*a* 104*b* can be substantially rigid such that elastic deformations of the advanced calisthenic rings 100*a* 100*b* are generally unnoticeable by the human eye when subjected to typical human body weight (that is weights under approximately 300 lbs).

Figure 2A:
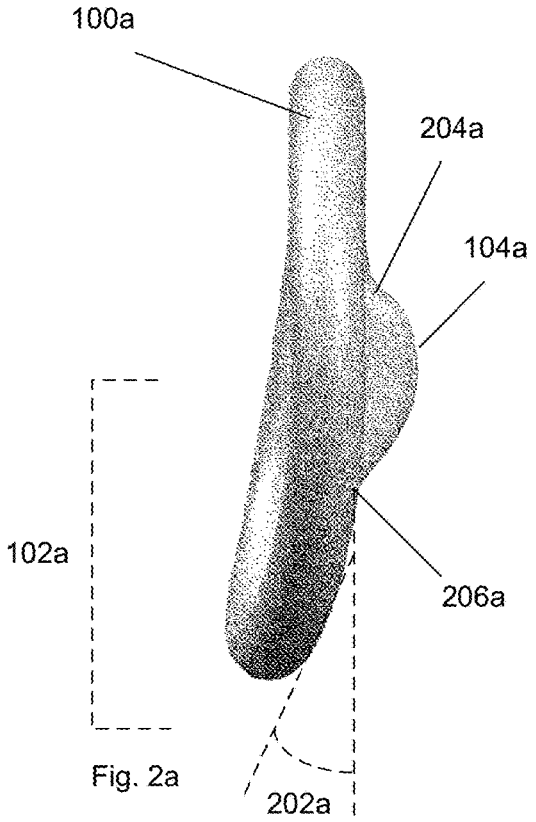
FIGS. 2*a* and 2*b* depict a top view of a pair of advanced calisthenic rings.
Figure 2B:
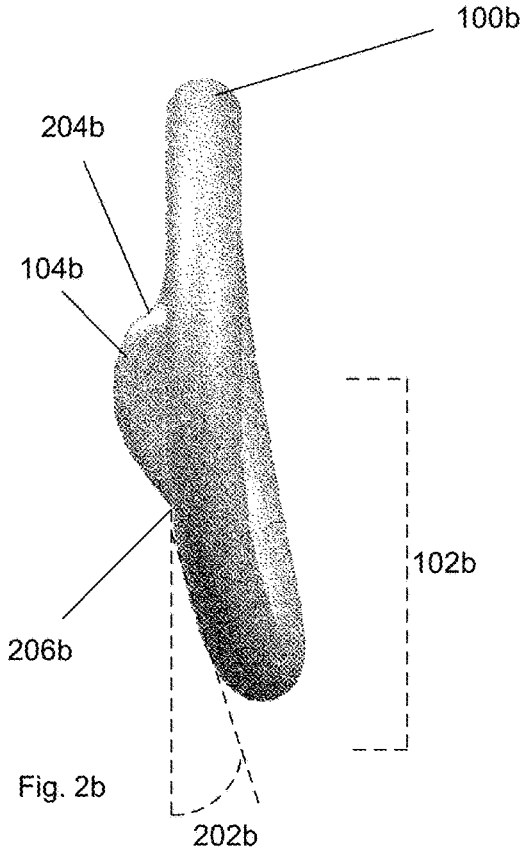

FIGS. 2*a* and 2*b* depict a top view of a pair of advanced calisthenic rings 100*a* 100*b* depicted in FIGS. 1*a* and 1*b*. In the embodiment depicted in FIGS. 2*a* and 2*b*, an angle 202*a* 202*b* can be defined between the main bodies of the advanced calisthenic rings 100*a* 100*b* and the first regions 102*a* 102*b*. In some embodiments the angles 202*a* 202*b* can be between about 1 degree and 20 degrees. Moreover, in some embodiments as depicted in FIGS. 2*a* and 2*b*, the entireties of the first regions 102*a* 102*b* may not reside in a single plane and can vary and/or undulate.

FIGS. 2*a* and 2*b* further depict an embodiment of the geometries and interface between the support elements 104*a* 104*b* and each of the advanced calisthenic rings 100*a* 100*b*. In the embodiments depicted in FIGS. 2*a* and 2*b*, the support elements 104*a* 104*b* can have geometries similar to or approximating a quadrant of a lemniscate centered about (0,0) or a longitudinally bifurcated teardrop shape wherein the rounded end of the support elements 204*a* 204*b* are proximate to the main body of the advanced calisthenic rings 100*a* 100*b* and the pointed ends 206*a* 206*b* of the support elements 104*a* 104*b* are proximate to the first regions 102*a* 102*b*. Moreover, as depicted in FIGS. 2*a* and 2*b*, the support elements 104*a* 104*b* can be integral with and the advanced calisthenic rings 100*a* 100*b* and can have smooth and continuous transitions, absent discontinuities.

Figure 3A:
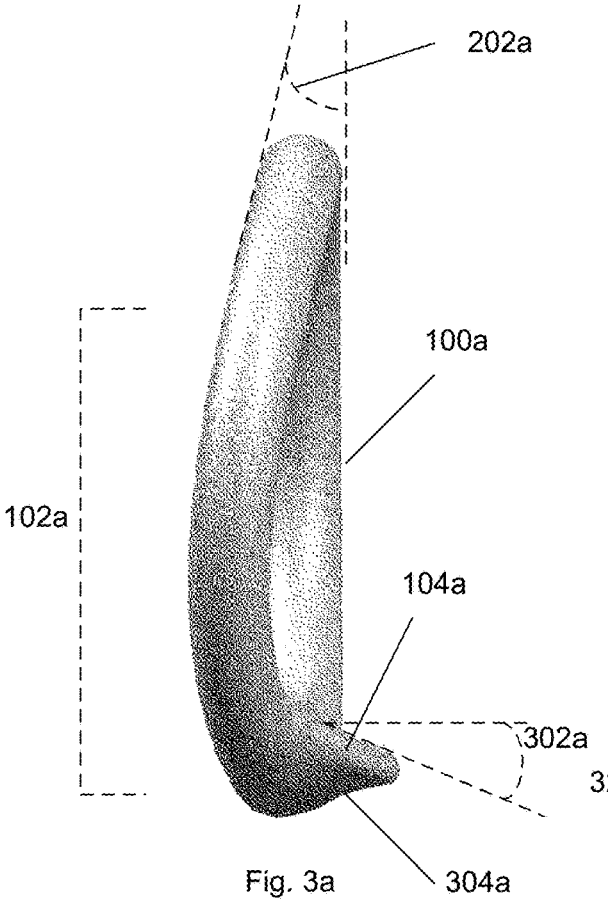
FIGS. 3*a* and 3*b* depict a rear elevation view of a pair of advanced calisthenic rings.
Figure 3B:
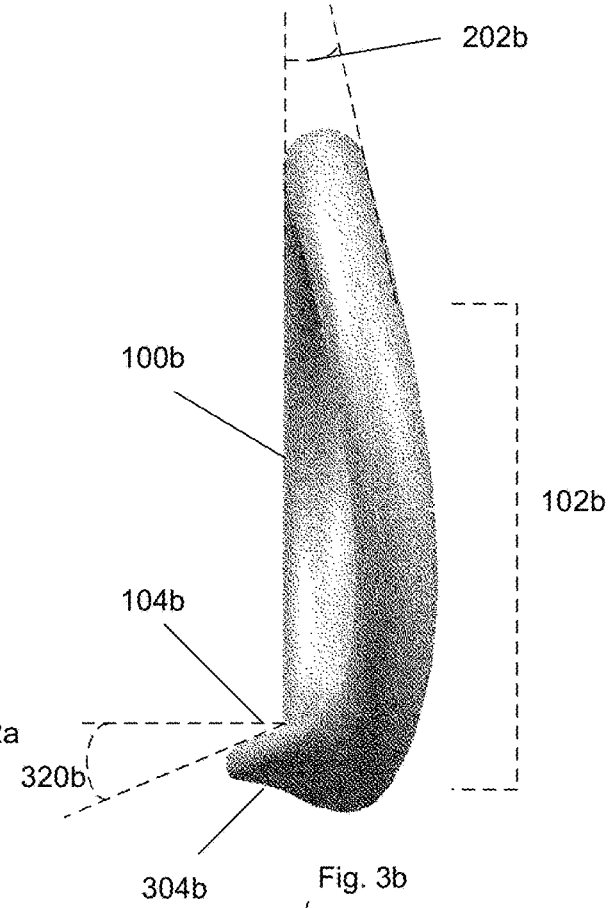

FIGS. 3*a* and 3*b* depict a rear elevation view of a pair of advanced calisthenic rings 100*a* 100*b* and further depicts the angles 202*a* 202*b* of the first regions 102*a* 102*b* relative to the main bodies of the advanced calisthenic rings 100*a* 100*b*. As depicted in FIGS. 3*a* and 3*b*, the advanced calisthenic rings 100*a* and 100*b* can be smooth and continuous, absent discontinuities, and can vary and/or undulate.

In the embodiment depicted in FIGS. 3*a* and 3*b*, the support elements 104*a* 104*b* can have an angle 302*a* 302*b* relative to horizontal and/or can taper in thickness 304*a* 304*b* from the edge proximate to the main body of the advanced calisthenic rings 100*a* 100*b* and the perimeter edges of the support elements 104*a* 104*b*. In some embodiments the angles can be in the range of 0 to 30 degrees.

Figure 4A:
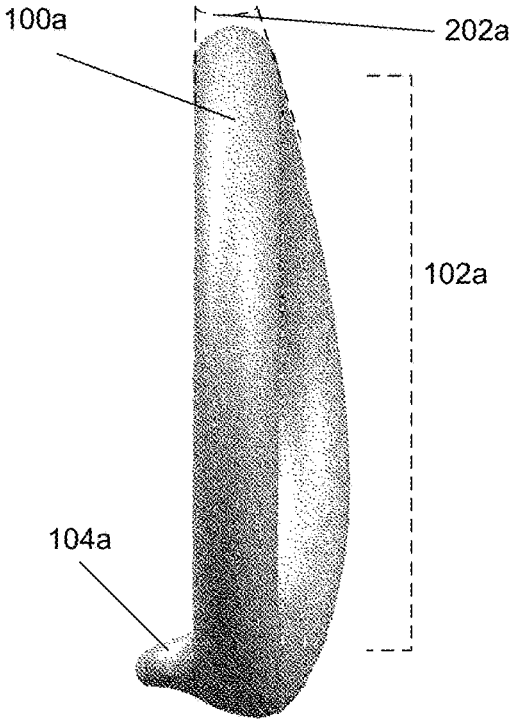
FIGS. 4*a* and 4*b* depict a front elevation view of a pair of advanced calisthenic rings.
Figure 4B:
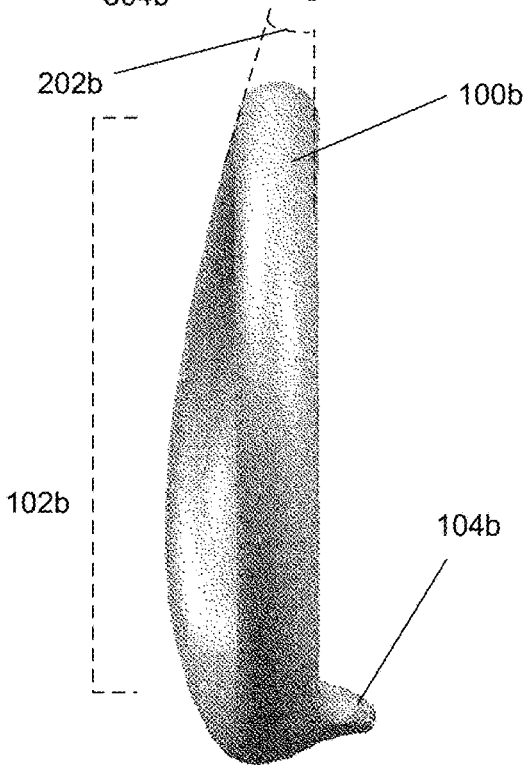

FIGS. 4*a* and 4*b* depict a front elevation view of a pair of advanced calisthenic rings 100*a* 100*b* and further depicts the angles 202*a* 202*b* of the first regions 102*a* 102*b* relative to the main bodies of the advanced calisthenic rings 100*a* 100*b*. As depicted in FIGS. 3*a* and 3*b*, the advanced calisthenic rings 100*a* and 100*b* can be smooth and continuous, absent discontinuities, and can vary and/or undulate.

Figure 5A:
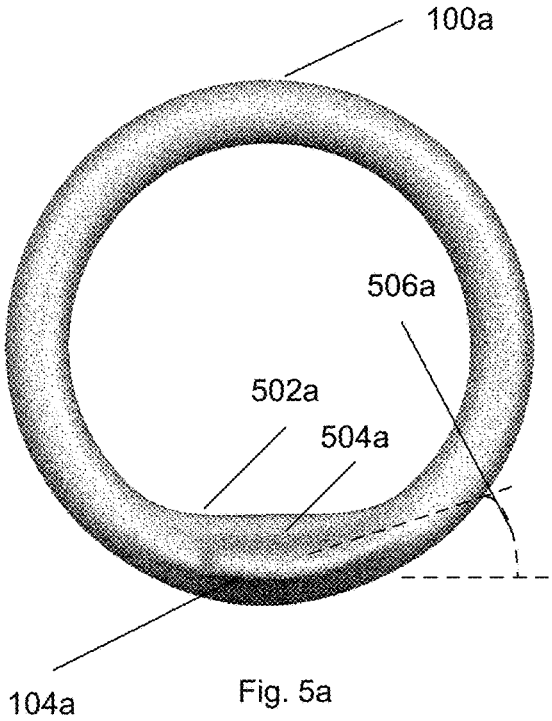
Figure 5A:
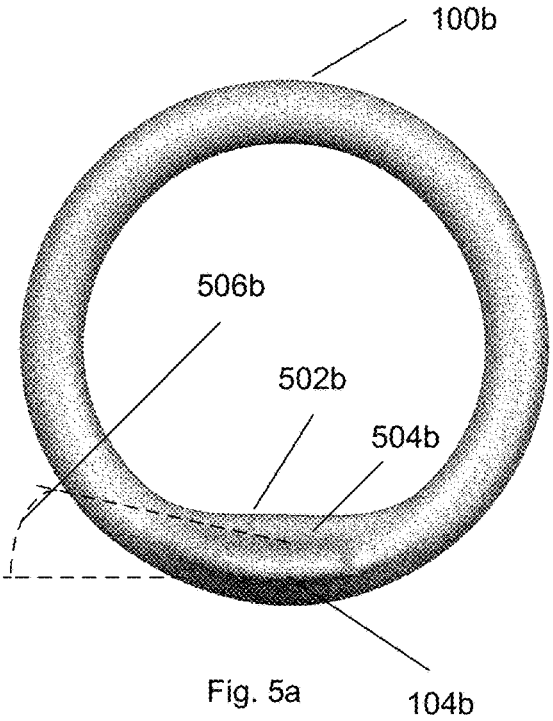
Figure 6A:
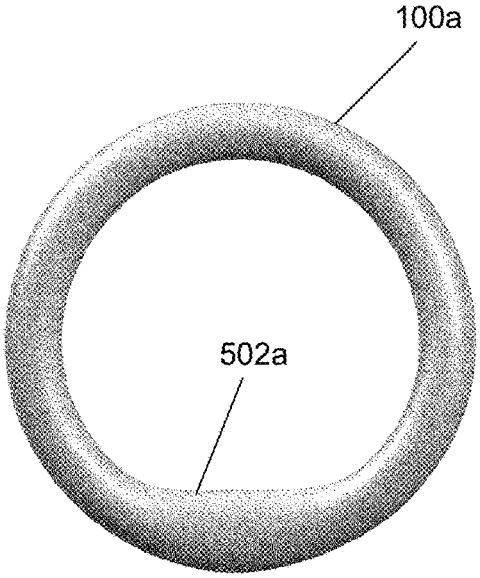
FIGS. 6*a* and 6*b* depict an exterior elevation view of a pair of advanced calisthenic rings.
Figure 6B:
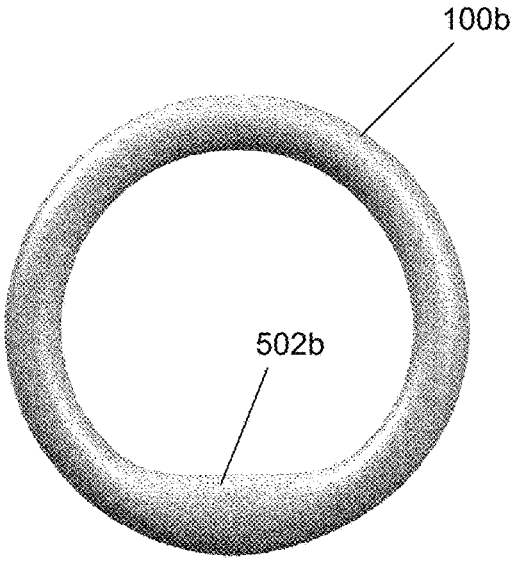

FIGS. 5*a* and 5*b* depict an interior elevation view of a pair of advanced calisthenic rings 100*a* 100*b* and FIGS. 6*a* and 6*b* depict an exterior elevation view of a pair of advanced calisthenic rings 100*a* 100*b*. As depicted in FIGS. 5*a*-6*b*, the advanced calisthenic rings 100*a* 100*b* can have substantially flat regions 502*a* 502*b* proximate to the support elements 104*a* 104*b*. In some embodiments, the substantially flat regions 502*a* 502*b* can be adapted and configured to accommodate a portion of the palm of a human hand. Additionally, there can be smooth and/or continuous transitions 504*a* 504*b* between the main bodies of the advanced calisthenic rings 100*a* 100*b* and the support elements 104*a* 104*b*. Additionally, in some embodiments, the support elements 104*a* 104*b* can be at angles 506*a* 506*b* relative to the main bodies of the advanced calisthenic rings 100*a* 100*b* and/or substantially flat regions 502*a* 502*b*. In some embodiments, the angles 506*a* 506*b* can be in the range of 0 to 15 degrees.

Figure 7:
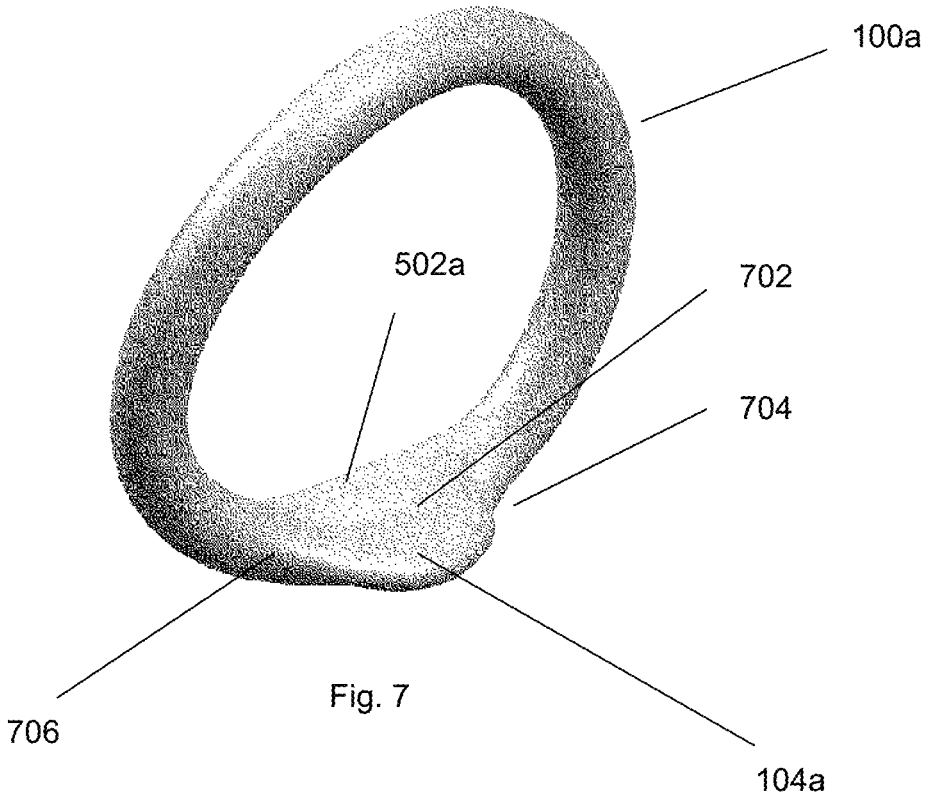
FIG. 7 depicts an isometric view of the interior of an advanced calisthenic ring.

FIG. 7 depicts an isometric view of an interior of advanced calisthenic ring 100*a*. As depicted in FIG. 7, the advanced calisthenic ring 100*a* can include a smooth, curved, continuous transition 702 between the substantially flat region 502*a* and the support element 104*a*. In some embodiments, the rounded edge interface 704 between the advanced calisthenic ring 100*a* and the support element 104*a* can be adapted and configured to accommodate the interface between the index finger and the thumb of a human hand, proximal to the abductor pollicis transversus and/or flexor pollicis longus.

Figure 8:
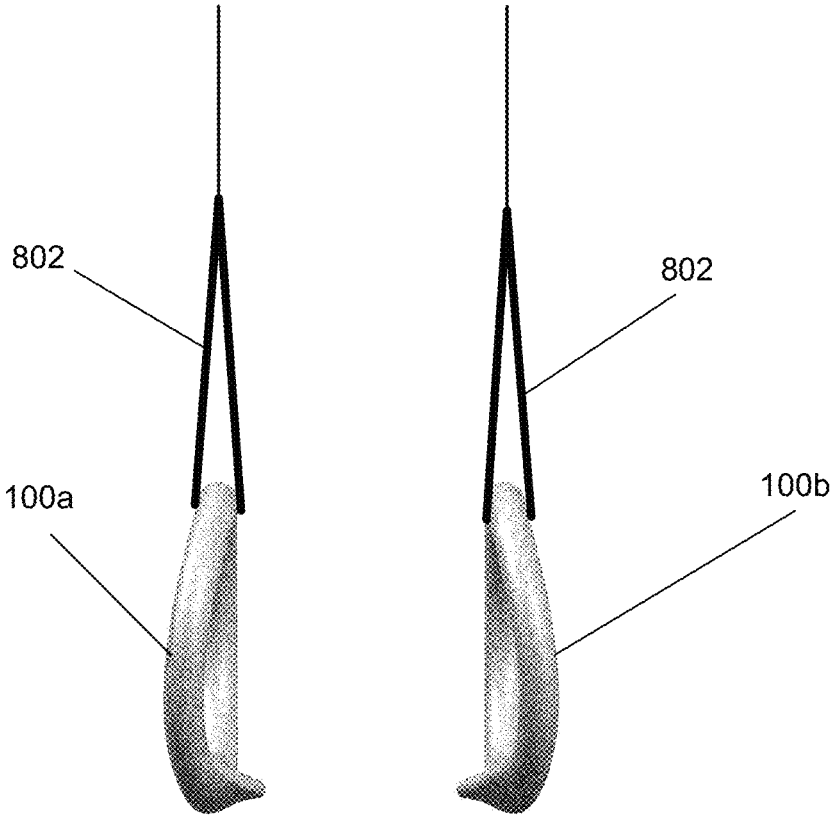
FIG. 8 depicts an isometric view of a pair of advances calisthenic rings attached to ring support straps.

FIG. 8 depicts an isometric view of a pair of advances calisthenic rings 100*a* 100*b* attached to ring support straps 802. As depicted in FIG. 8, the ring support straps 802 can be coupled with the advanced calisthenic rings 100*a* 100*b* by looping the ring support straps 802 through the advanced calisthenic rings 100*a* 100*b*.

In operation, a user can adopt what is commonly referenced as a false grip of the advanced calisthenic rings 100*a* 100*b* by placing the wrists in flexion and inserting the fingers of the hands through the advanced calisthenic rings 100*a* 100*b* and around the interior of the advanced calisthenic rings 100*a* 100*b* with the anterior portions of the wrists against the perimeter edges of support elements 104*a* 104*b* and the thumbs at the bulbous interface 704 of the support elements 104*a* 104*b* and the advanced calisthenic rings 100*a* 100*b*. A user can then perform what is commonly referred to as a muscle up exercise commenced from the false grip position and the advanced calisthenic rings 100*a* 100*b* can assist a user with correct alignment of the wrist through the exercise. Additionally, in some embodiments, the advanced calisthenic rings 100*a* 100*b* can be rotated relative to the ring support straps 802 such that a user can perform the muscle up exercise from the false grip start position without the assistance of the support elements 104*a* 104*b*.

Although exemplary embodiments of the invention have been described in detail and in language specific to structural features and/or methodological acts above, it is to be understood that those skilled in the art will readily appreciate that many additional modifications are possible in the exemplary embodiments without materially departing from the novel teachings and advantages of the invention. Moreover, it is to be understood that the subject matter defined in the appended claims is not necessarily limited to the specific features or acts described above. Accordingly, these and all such modifications are intended to be included within the scope of this invention construed in breadth and scope in accordance with the appended claims.

What is claimed is:

1. An exercise device comprising:

an undulating, non-planar, substantially annular member having a first region and a second region; and a support element unitary with and extending from a portion of said undulating, non-planar substantially annular member, wherein a first surface of said support element is instantaneously substantially orthogonal to said portion of said undulating, non-planar substantially annular member;

wherein said first region of said undulating, non-planar substantially annular member is askew relative to said second region of said undulating, non-planar substantially annular member and wherein an obtuse angle is defined between the two regions.

2. The exercise device of claim 1 wherein the undulating, non-planar substantially annular member has a substantially smooth transition between said first region and said second region.

3. The exercise device of claim 2 wherein said support element has a perimeter edge that is substantially approximating the perimeter edge of one quadrant of a lemniscate.

4. The exercise device of claim 2 wherein said support element has a perimeter edge that is substantially approximating the perimeter edge of a longitudinally bisected teardrop shape.

5. The exercise device of claim 2 wherein said portion of said undulating, non-planar substantially annular member is positioned at the substantially smooth transition between said first region and said second region.

6. The exercise device of claim 5 wherein said undulating, non-planar substantially annular member is substantially rigid.

7. The exercise device of claim 2 wherein said substantially planar support element is integral with said undulating, non-planar substantially annular member.

8. The exercise device of claim 7 wherein a thickness of said support element tapers from a point of contact with said annular ring to a perimeter edge of said support element.

9. The exercise device of claim 1 wherein the undulating, non-planar substantially annular member has a substantially smooth transition between said first region and said second region.

10. The exercise device of claim 9 wherein said support element has a perimeter edge that is substantially approximating the perimeter edge of one quadrant of a lemniscate.

11. The exercise device of claim 10 wherein said support element is integral with said undulating, non-planar substantially annular member and wherein an interface between said support element and said undulating, non-planar substantially annular member is a smooth, curved transition absent discontinuities.

12. The exercise device of claim 9 wherein said support element has a perimeter edge that is substantially approximating the perimeter edge of a longitudinally bisected teardrop shape.

13. The exercise device of claim 12 wherein said undulating, non-planar substantially annular member is substantially rigid.

14. The exercise device of claim 9 wherein said portion of said undulating, non-planar substantially annular member is positioned at the substantially smooth transition between said first region and said second region.

15. The exercise device of claim 14 wherein said undulating, non-planar substantially annular member is substantially rigid.

* * * * *